US008347467B2

(12) United States Patent
Davis et al.

(10) Patent No.: US 8,347,467 B2
(45) Date of Patent: Jan. 8, 2013

(54) LIGHTWEIGHT VIEWING CASKET WITH REINFORCING LID AND METHOD OF USING SAME

(75) Inventors: Gerald Davis, Fountain City, IN (US); Chad L. Eversole, Richmond, IN (US); Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 12/831,248

(22) Filed: Jul. 6, 2010

(65) Prior Publication Data

US 2011/0000059 A1 Jan. 6, 2011

Related U.S. Application Data

(60) Provisional application No. 61/222,941, filed on Jul. 3, 2009.

(51) Int. Cl.
*A61G 17/00* (2006.01)

(52) U.S. Cl. ..... 27/14; 27/4; 27/15; 27/17; 229/125.01

(58) Field of Classification Search ..... 27/4, 14, 27/17, 2, 15; 220/256.1; 229/125.01, 125.02, 229/125.05, 125.06, 125.41, 125.12
See application file for complete search history.

(56) References Cited

U.S. PATENT DOCUMENTS

| | | | | |
|---|---|---|---|---|
| 2,708,302 | A * | 5/1955 | Wilkirson | 27/2 |
| 2,940,155 | A * | 6/1960 | Horn | 27/17 |
| 2,995,800 | A * | 8/1961 | Pitt | 27/17 |
| 3,692,230 | A * | 9/1972 | Kapiloff | 229/125.06 |
| 3,951,332 | A * | 4/1976 | Torbeck | 229/241 |
| 4,123,831 | A * | 11/1978 | Covington | 27/2 |
| 4,156,956 | A * | 6/1979 | Partridge et al. | 27/4 |
| 4,556,167 | A * | 12/1985 | Fox et al. | 229/125.41 |
| 4,730,370 | A * | 3/1988 | Elder | 27/4 |
| 4,773,134 | A * | 9/1988 | Kay | 27/14 |
| 4,868,957 | A * | 9/1989 | Rojdev | 27/17 |
| 4,882,821 | A * | 11/1989 | Sims, Jr. | 27/17 |
| 4,944,076 | A * | 7/1990 | Kay et al. | 27/14 |
| 5,307,545 | A * | 5/1994 | Stoltz | 27/4 |
| 5,586,679 | A * | 12/1996 | Thomas | 27/4 |
| 5,623,752 | A * | 4/1997 | Gillard et al. | 27/2 |
| 5,661,879 | A * | 9/1997 | Kelly | 27/2 |
| 7,003,855 | B2 * | 2/2006 | Lew | 27/4 |
| 7,213,312 | B2 * | 5/2007 | Foroni | 27/4 |
| 7,249,403 | B2 * | 7/2007 | Davis et al. | 27/27 |
| 7,263,751 | B2 * | 9/2007 | Davis et al. | 27/4 |

* cited by examiner

*Primary Examiner* — William L. Miller
(74) *Attorney, Agent, or Firm* — Maginot, Moore & Beck

(57) ABSTRACT

A casket arrangement includes a casket body, a first lid portion, and a second lid portion. The casket body is in the form of an open top box with a bottom, side walls or panels, and end walls or panels. The second lid portion includes a tab configured to fit under a top panel of the first lid portion.

17 Claims, 8 Drawing Sheets

LIGHTWEIGHT VIEWING CASKET WITH REINFORCING LID AND METHOD OF USING SAME

This application claims the benefit of U.S. Provisional Patent Application Ser. No. 61/222,941, filed Jul. 3, 2009.

FIELD OF THE INVENTION

The present invention relates to caskets, and particularly to lightweight caskets.

BACKGROUND OF THE INVENTION

Caskets can be employed for both display and interment of a deceased. Because of the display aspect, a casket must convey dignity and respect for the deceased. To accomplish the foregoing, it is known to manufacture caskets from hardwoods and metal, providing them with decorative features. However, the cost of such caskets can be beyond the reach of many.

Accordingly, caskets formed of corrugated paperboard and/or manufactured wood products have been developed. Such products can be manufactured at a much lower cost than the hardwood and metal caskets. However, significant costs remain in both material and shipment of caskets made from lower cost materials.

In addition, corrugated paperboard caskets are not structurally durable as wood or metal caskets. Accordingly, there is a need for reducing cost of material and shipment of caskets made from lower cost materials while maintaining the structural integrity of the casket.

SUMMARY OF THE INVENTION

Embodiments of caskets disclosed herein include several features that can lower the cost of manufacture and/or shipment of the casket. Savings can be obtained even if less than all of the novel features disclosed herein are employed.

In general, an embodiment of a casket includes a two-piece lid and a container. The container is generally in the form of an open-top box and is configured to receive a body of a deceased. The first lid part covers the lower part of the body and the second lid part covers the upper part of the body and head. The casket body and the lid are preferably configured from corrugated paper. The first part of the lid has a top panel having four edges, and three vertical sides extending from three of the four edges, such that one vertical side extends down over the foot end panel of the casket body, and two vertical sides extend over foot end portions of the side panels of the casket body. Two securing means secure a front portion of two vertical sides to an intermediate portion of the casket body.

The second part of the lid has substantially the same configuration as the first part of the lid, but does not include the securing means. In addition, the fourth edge of the second lid portion (from which a vertical sides does not extend) includes a tab portion extending therefrom.

The first and second lid portions are removed from the casket body during insertion of a deceased. For viewing purposes, only the first part of the lid is inserted onto the casket body. To this end, the three vertical sides of the first lid part extend over corresponding panel portions of the foot end portion of the casket. The securing means are then used to secure the front portion (furthest from the foot end panel) to the corresponding intermediate portion of the casket side panels. As such, the first lid part covers the lower part of the deceased in the interior of the casket body. Moreover, the first lid portion serves to reinforce the strength of the side panels of the casket. The coupling at the front end of the first part of the lid and the casket body side panel helps stop relative sliding between the first part of the lid and casket body, which further helps reinforce the side from buckling.

After viewing, the second part of the lid is placed over the head end portion of the casket. To this end, the tab on the fourth edge of the lid is inserted under the corresponding edge of the second end part of the lid. The remainder of the second part of the lid is then placed over the head end part of the casket body.

In another embodiment of the invention, the sides of a corrugated paper casket are reinforced with a reinforcement strip that is disposed on the inside of the side wall just above handle openings in the side walls.

The above discussed features and advantages, as well as others, will become more readily apparent to those of ordinary skill in the art by reference to the following detailed description and accompanying drawings.

DETAILED DESCRIPTION

Figure 7:
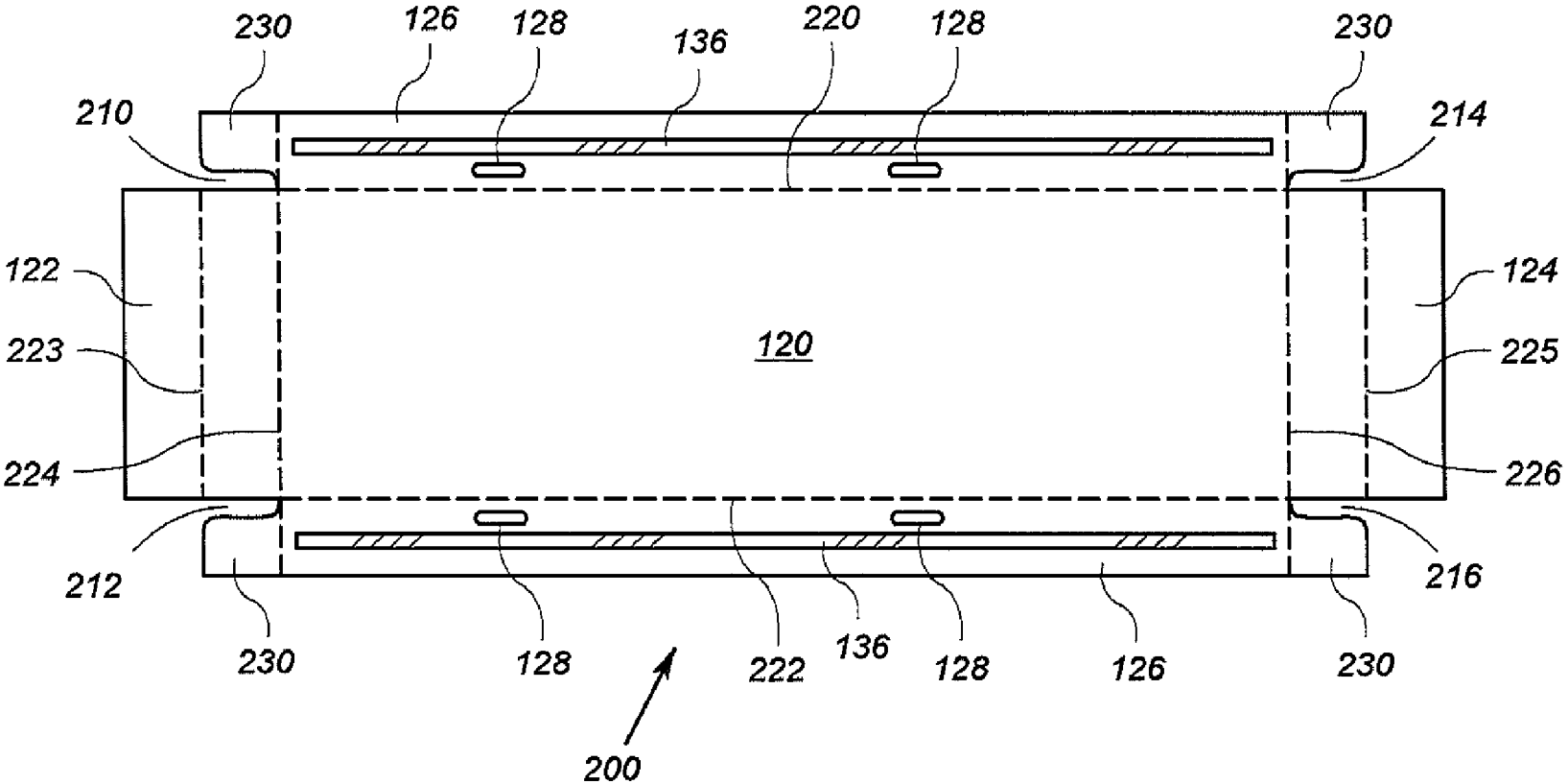
FIG. 7 shows top plan view of a corrugated paper blank for the casket of FIG. 6.

An exemplary casket arrangement 10 according to the invention includes a casket body 12, a first lid part 14, a second lid part 16. The casket body 12 is preferably in the form of an open-top box formed of corrugated paper. The casket body 12 may suitably be formed by folding and gluing a properly die-cut corrugated paper blank. FIG. 7 shows an example of a die-cut corrugated paper blank 200 that may be used to form the casket body. Referring again to FIG. 1, the casket body 12 includes a bottom panel 20, a head end panel 22, a foot end panel 24, and side panels 26. In an exemplary embodiment, the side panel 26 includes handle openings or structures 28 and holes 29 for receiving a tie mechanism. The bottom panel 20 is preferably rectangular and extends a length sufficient to extend beyond the length of a deceased, for example, 76 or 80 inches. The short sides of the bottom panel define the length of the head end panel 22 and the foot end panel 24, and the long sides of the bottom panel define the length of the side panels 26.

The first lid part 14 is preferably formed of corrugated paper. The first lid part 14 may suitably be formed by folding and gluing a properly die cut corrugated paper blank. The first lid part 14 includes a top panel 30, a foot end panel 32, and side panels 34. In an exemplary embodiment, at least one of the side panels 34 includes holes 36 for receiving a tie mechanism 50.

The second lid part 16 is also preferably formed of corrugated paper. Similar to the first lid part 14, the second lid part 16 may suitably be formed by folding and gluing a properly die cut corrugated paper blank. The second lid part 16 includes a top panel 40, a head end panel 42, and side panels 44. The top panel 40 includes a tab 46 that extends outward from the line formed on the top panel 40 between the ends of the side panels 44.

The first lid part 14 and the second lid part 16 are configured such that they cooperate to cover the entire casket body 12. Substantially the only overlap between the parts 14 and 16 is the tab 46 which overlaps with a portion of the top panel 30. While in this embodiment, the first lid part 14 and second lid part 16 fit over (i.e. outside) the panels 40, 42 and 44, in other embodiments, the lid parts 14, 16 may fit just inside the panels 40, 42 and 44.

Figure 5:
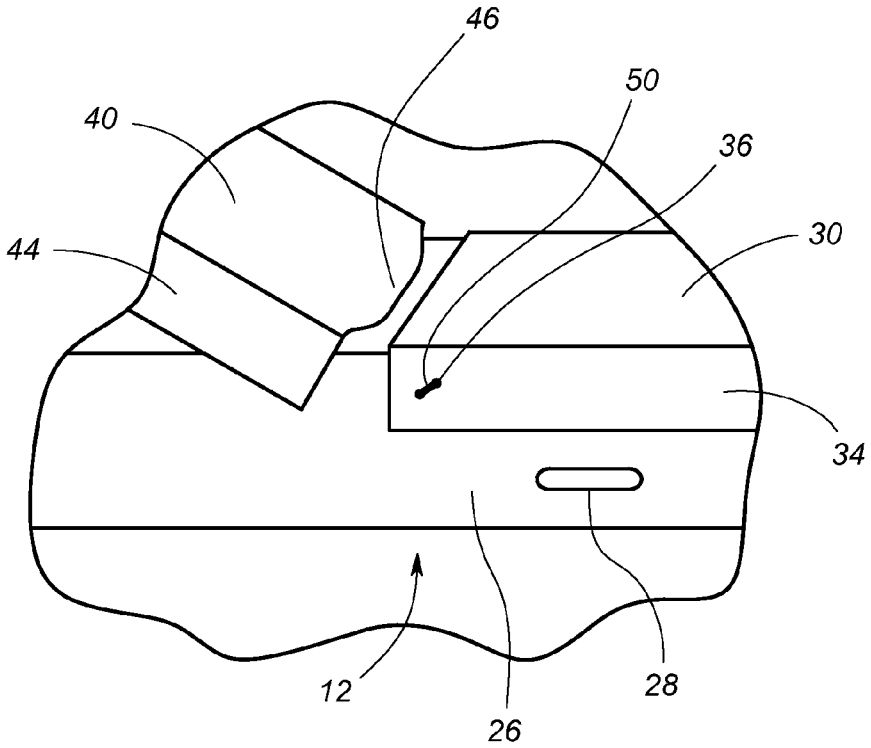
FIG. 5 shows a perspective fragmentary view of the second lid part being placed into position to close the casket.

The holes 29 and 36 line up when the second lid part 16 is assembled onto the casket body 12. As shown in FIG. 5, a tie-wrap 50 or other mechanism is inserted around both sets of holes 29 and 36. It will be appreciated that the tie-wrap 50 and holes 29 and 36 may be replaced by other attachment means, such as adhesive, staples, other fasteners, or even a clasp or connector formed from the paperboard itself.

Figure 4:
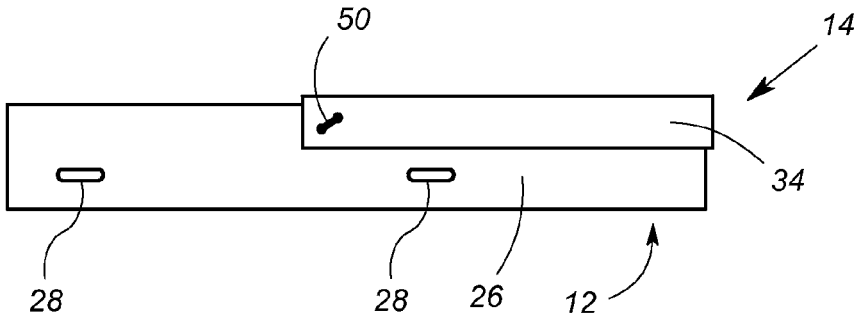
FIG. 4 shows a side view of the casket of FIG. 1 arranged with one of the lid portions removed for viewing.

FIG. 4 shows the casket body 12 and first lid portion 14 thereon for viewing. The second lid portion 16 is removed such that the interior of the head end of the casket body 12 may be viewed. The tie-wrap 50 is connected to help prevent sliding of the first lid portion 14 with respect to the casket body 12. In this position, the combined action of the end panel 32, side panels 34, and the attachment means provides reinforcement to the side panels 26 of the casket body 12.

Figure 1:
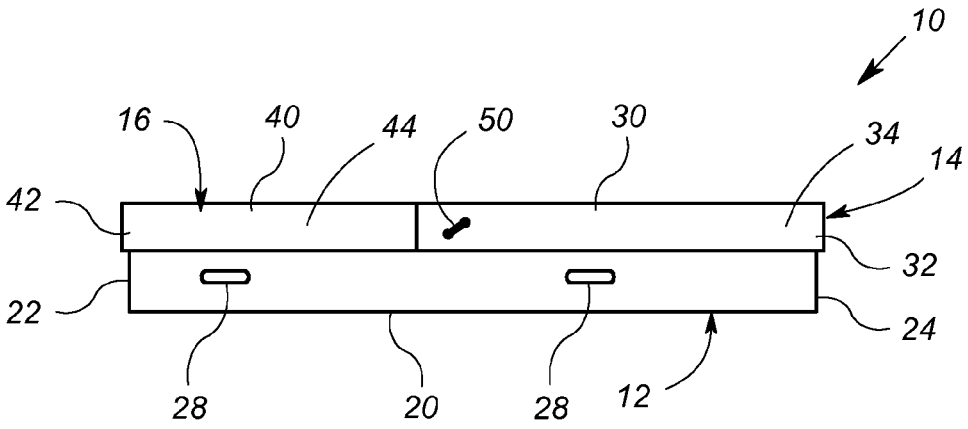
FIG. 1 shows a side view of a casket arrangement according to the invention.
Figure 2:
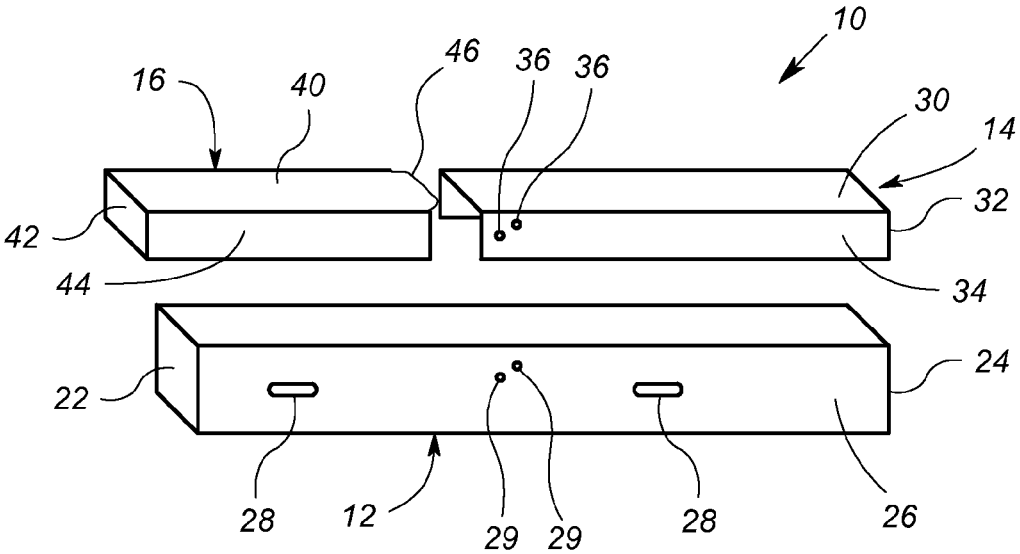
FIG. 2 shows an exploded side perspective view of the casket arrangement of FIG. 1.
Figure 3:
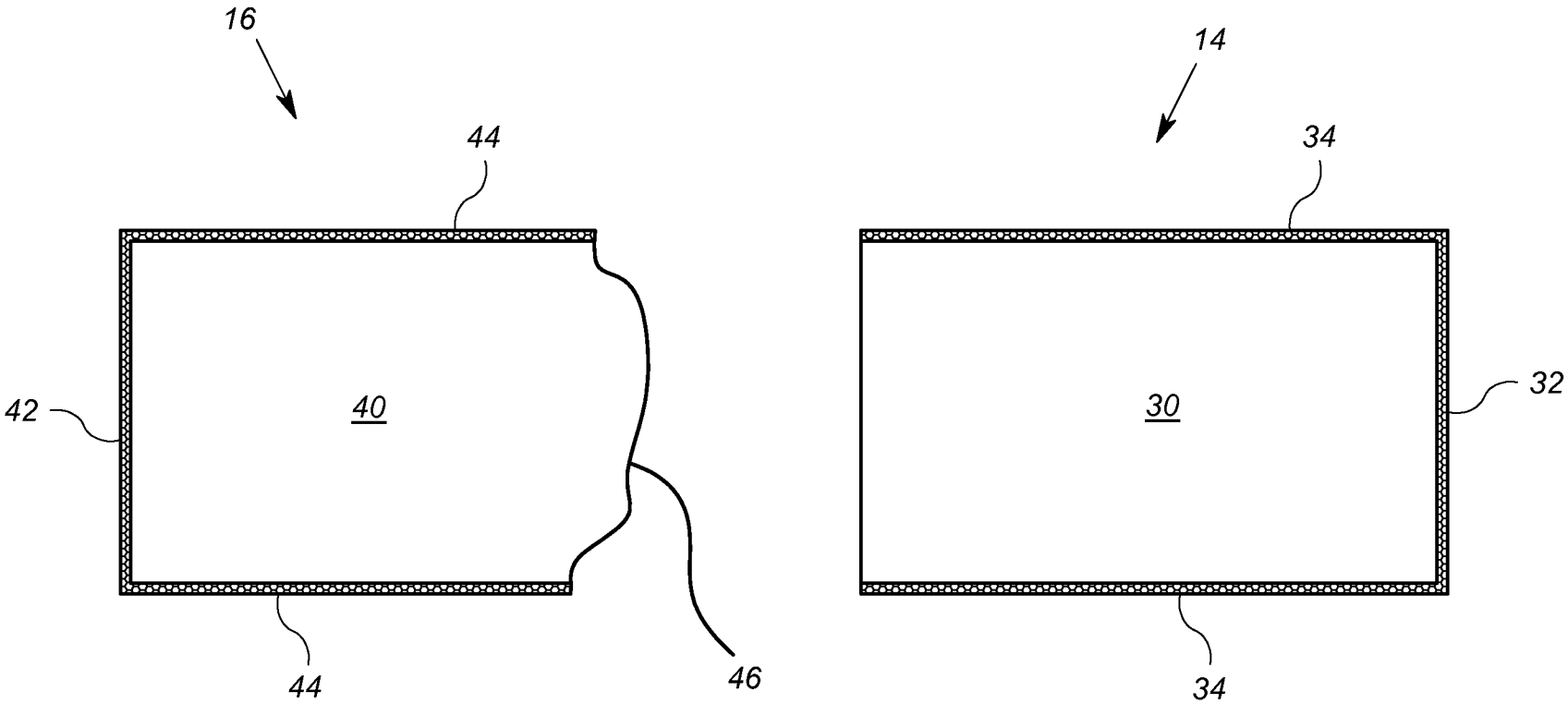
FIG. 3 shows a bottom plan view of the two lid portions of the casket arrangement of FIG. 1.

To close the casket arrangement 10, the tab 46 of the second lid portion 16 is slid under the end of the top panel 30. It may be helpful to tilt the second lid portion 16 to facilitate placement of the tab under the end of the top panel 30. When closed, the casket arrangement 10 appears as shown in FIG. 1.

Figure 6:
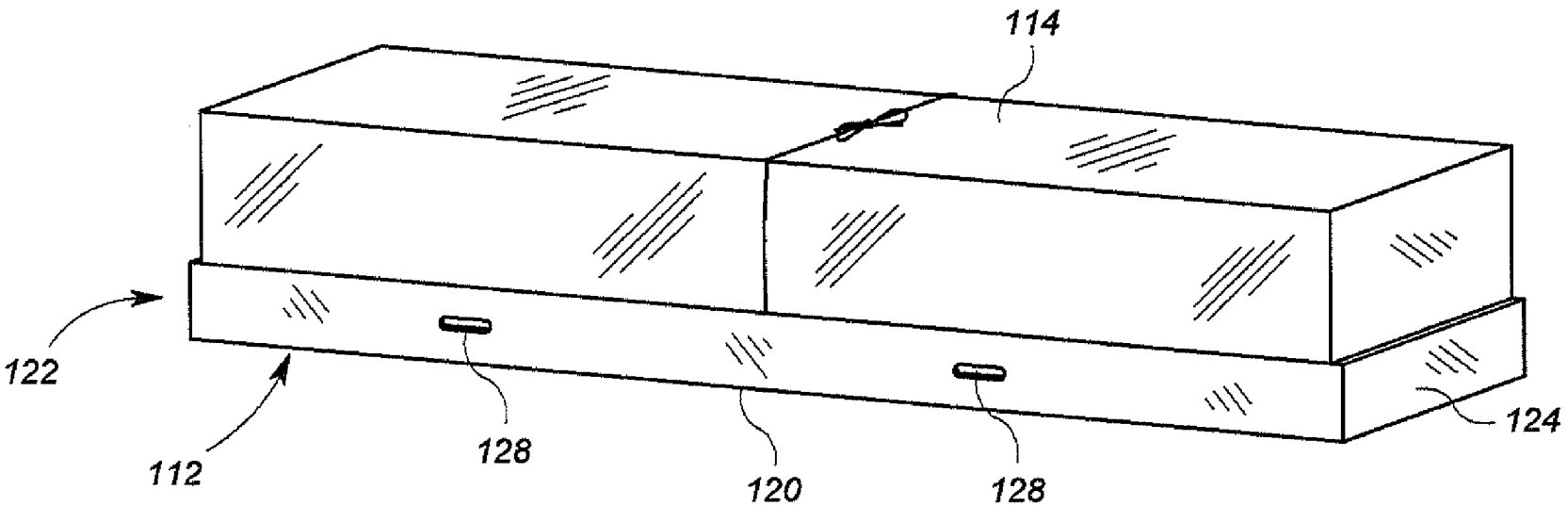
FIG. 6 shows a perspective view of a second embodiment of an inventive casket.

FIG. 6 shows an alternative embodiment of a casket 100 that includes strengthening features and a convenient assembly. The exemplary casket arrangement 100 according to the invention includes a casket body 112 and a one piece-lid 114. The casket body 112 is preferably in the form of an open-top box formed of corrugated paper. The casket body 112 may suitably be formed by folding and gluing a properly die-cut corrugated paper blank. FIG. 7 shows an example of a die-cut corrugated paper blank 200 that may be used to form the casket body 112. Referring again to FIG. 6, the casket body 112 includes a bottom panel 120, a head end panel 122, a foot end panel 124, and side panels 126. In an exemplary embodiment, the side panel 126 includes handle openings or structures 128.

Although not shown in FIG. 6, the bottom panel 120 is preferably rectangular and extends a length sufficient to extend beyond the length of a deceased, for example, 76 or 80 inches. As seen more clearly in FIG. 7 and discussed further below, the short sides of the bottom panel 120 define the length of the head end panel 122 and the foot end panel 124, and the long sides of the bottom panel 120 define the length of the side panels 126.

The casket lid 114 in this embodiment fits within the interior of the casket body, such that the lower edges of the lid 114 are hidden from view in FIG. 6 within the casket body 112. The casket lid 114 is in the general form of an open box container. In this embodiment, however, as shown in FIG. 8*c*, the corner areas 130 of the casket lid extend further than the side portions of the bottom panel. In this manner, the corner areas 130 engage the bottom panel 130 and define the furthest extend of the lid 114 into the casket body 112.

The casket body 112 also includes a leak resistant liner 132 formed of chemical resistant plastic sheeting, a nylon tie 134, and a pair of wooden side supports or braces 136, none which are shown in FIG. 6, but are shown in FIG. 7.

FIG. 7 shows a blank 200 out of which the casket body 112 is made, along with the two support braces 136 attached thereto. The blank 200 is a corrugated cardboard sheet that is generally rectangular, including two cutouts 210, 212 at a first end and two cutouts 214, 216 at a second end thereof. The blank 200 includes a central piece defining the bottom panel 120. The periphery of the portion defining the bottom panel 120 includes slit-scores 220, 222, 224 and 226. The slit score 220 extends a length of the bottom panel and defines a fold line between the bottom panel 120 and one of the side panels 126. The slit score 222 extends a length of the bottom panel on the opposite side and defines a fold line between the bottom panel 120 and the other side panel 126.

The slit score 224 extends a width of the bottom panel 120 and defines a fold line between the bottom panel 120 and the head end panel 122. The portion of the blank 200 that forms the head end panel 122 is twice as wide as the height of the head end panel 122. Accordingly, the portion of the blank 200 that forms the head end panel 122 is folded again over itself along a fold line defined by an additional slit score 223. The resulting head end panel 122 thus has twice the thickness of the side wall 126.

Similarly, the slit score 226 extends along the width of the bottom panel 120 on the opposite side and defines a fold line between the bottom panel 120 and the foot end panel 124. Like the head end panel 122, the portion of the blank 200 that forms the foot end panel 124 is twice as wide as the height of the foot end panel 124, and is folded again over itself along a fold line defined by an additional slit score 225.

The handle openings 128 are defined in the portions that form side walls 126. On either side wall structure 126, a brace 136 is disposed. Each of the braces 136 in this embodiment is a wooden strip that is 1¾ inches wide (or high) and ½ inch thick. The braces 136 may suitably extend most or all of the length of the side walls 126. Each of the braces 136 is secured, for example by glue, to the respective side wall 126 at a location outward (or upward) of the handle openings 128. Such a location provides increased strength for movement of the casket 100 by the handles.

The blank 200 also includes foldover tabs 230 at the ends of each side wall 126, defined by the cutouts 210, 212, 214 and 216. The foldover tabs 230 are configured to fold around and be secured to the outside of the end walls 122, 124. The tabs 230 may be secured by a small plastic tie, not shown, or by adhesive. In one embodiment, the tabs 230 are further designed to be received into vertical slots formed in the end walls 122, 124.

Figure 8A:
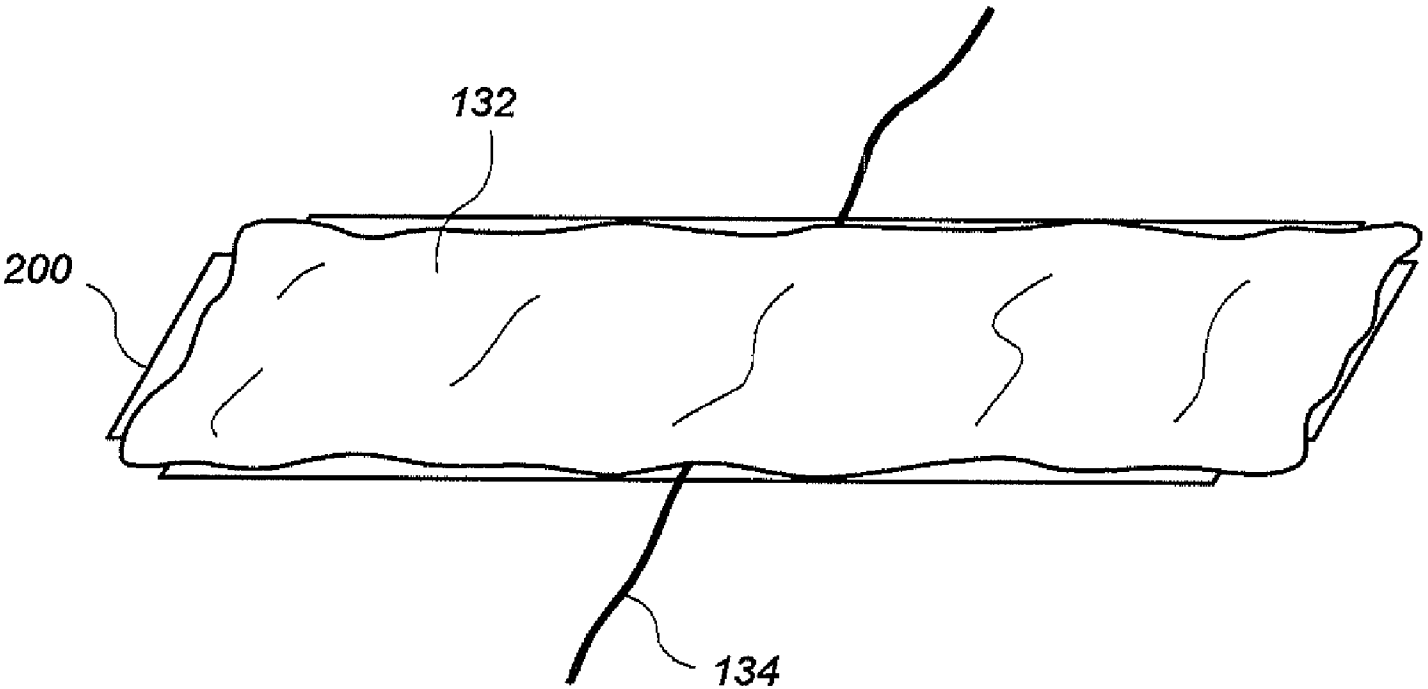
FIGS. 8*a*, 8*b* and 8*c* show perspective view of portions of the casket of FIG. 6 during assembly.
Figure 8B:
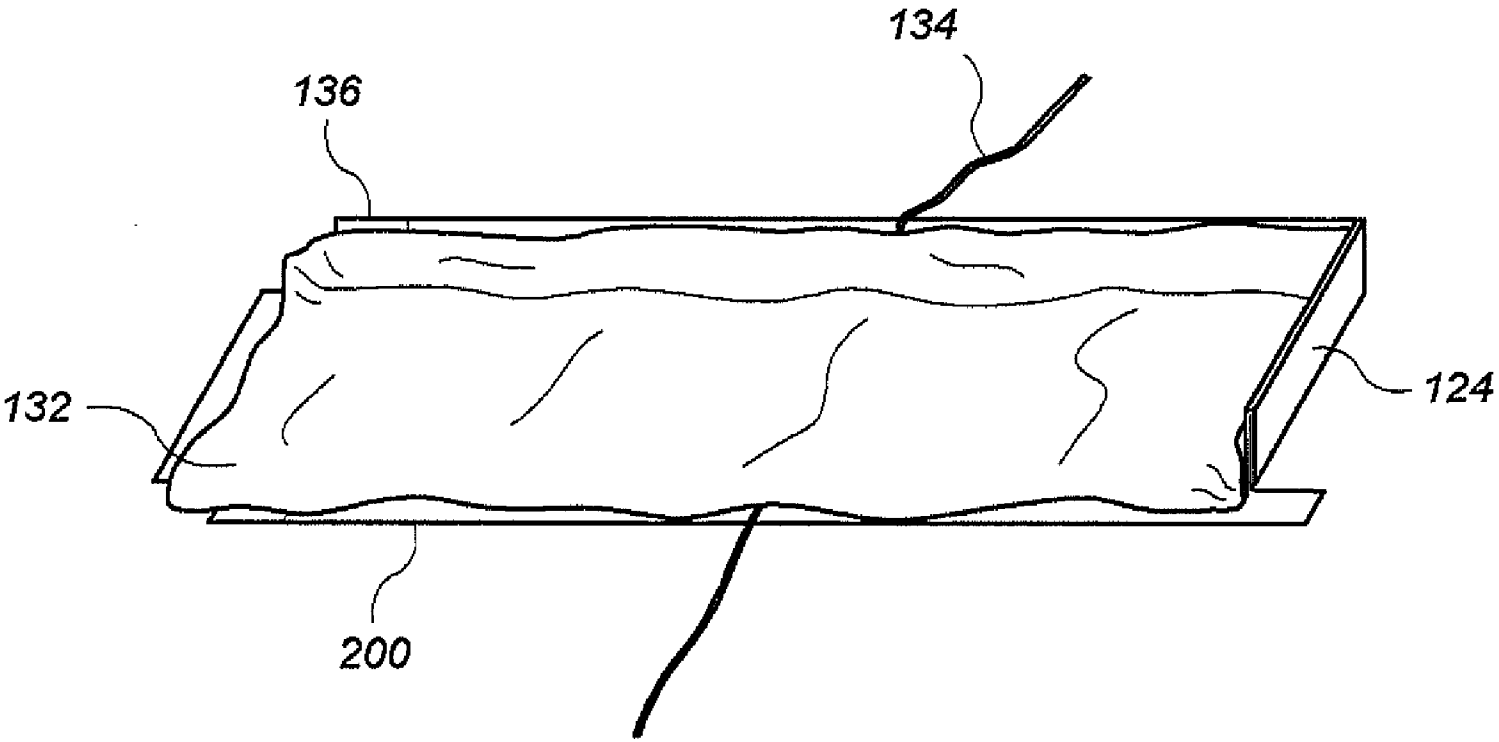
Figure 8C:
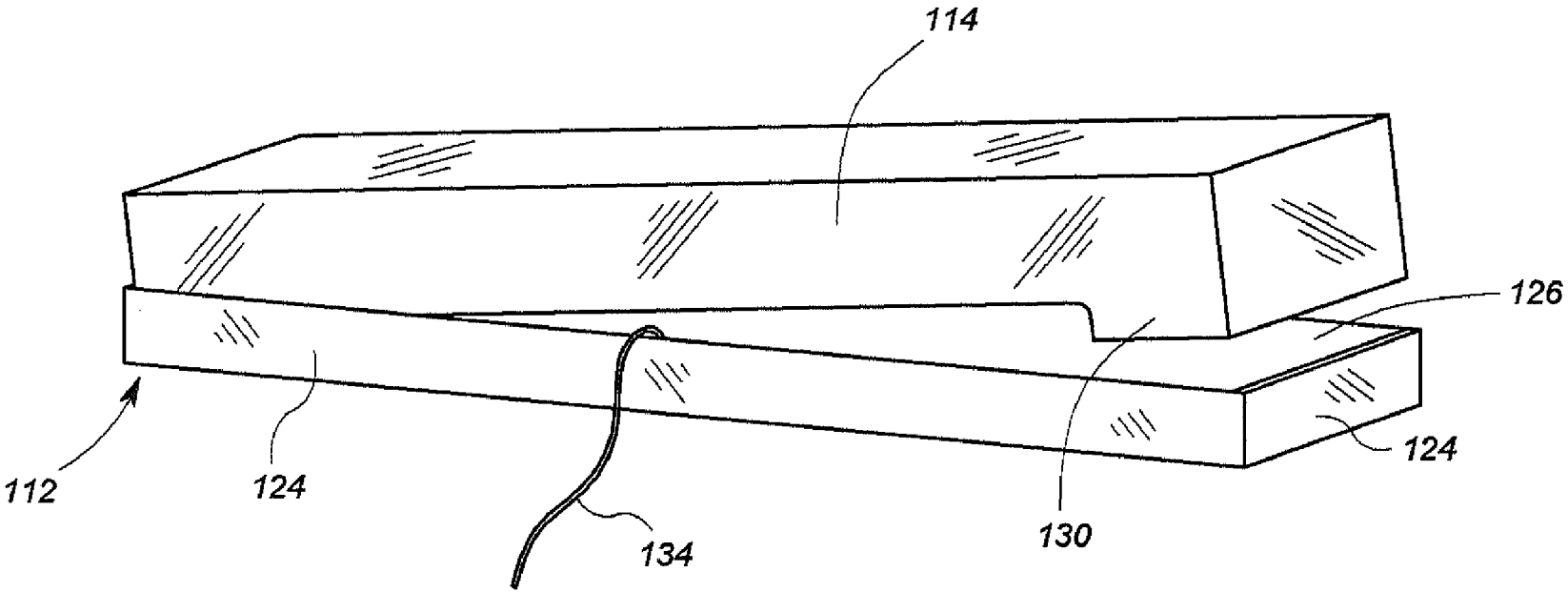

FIGS. 8*a*, 8*b* and 8*c* show the steps for constructing the blank 200 with the braces 136 into the body 112, and for applying the lid 114 thereto. In FIG. 8*a*, the assembly of FIG. 7 has been further outfitted with the liner 132 and the nylon tie 134. The nylon tie 134, which may be four to five feet in length or more, is secured to the blank 200 via staples or adhesive. The nylon tie 134 is disposed across the width of the blank 200 in a position between the head end panel 122 and the foot end panel 124. The liner 132 covers one side of the blank 200, and further covers the braces 136, and a portion of the nylon tie 134. The liner 132 is secured by adhesive.

FIG. 8*b* shows a perspective view of the casket body 112 in a partially constructed state. In FIG. 8*b*, a first side wall 126 has been folded up, and the foot end wall 124 has been folded up and over onto itself. The opposing side wall 126 and head end wall 122 have not yet been folded, but would be constructed in the same way. The tabs 130 can then be folded around the walls 122, 124 and secured thereto in order to complete the casket body 112.

FIG. 8*c* shows a perspective view of the casket body 112 and the lid 114 partially inserted therein. Once, the lid 114 is placed into the casket body 112. The nylon tie 134 is then tied or otherwise connected to secure the lid 114 to the casket body 112.

The embodiment of FIGS. 6, 7 and 8*a*-8*c* thus provides a design that has added strength provided by the braces 136, disposed above the handle openings 128. This provides reinforcement to the load bearing portion above the handle openings 128. In this embodiment, the braces 136 are formed from plywood. However, it will be appreciated that the braces 136 may alternatively be formed of other wood products such as plank wood or particle board. Moreover, suitable metal products may be used, although metal products are less useful for use in cremation.

It will be appreciated that the lid 114 may be replaced by a two-piece lid, such as that of the embodiment of FIG. 1. However, such a two-piece lid would be sized to fit within the casket body 112, as opposed to outside the casket body 12 as shown in FIG. 1.

It will be appreciated that the above described embodiments are merely exemplary, and that those of ordinary skill in the art may readily devise their own implementations and modifications that incorporate the principles of the present invention and fall within the spirit and scope thereof.

The invention claimed is:

1. A casket comprising:

a casket body in the form of an open top box;

a first lid portion non-destructively separable from the casket body; and a second lid portion non-destructively separable from the casket body, the second lid portion including:

a top panel having a top surface defining a first plane;

side panels connected to the top panel; and a tab that extends outwardly from the top panel and extends in a direction substantially coplanar with the first plane beyond ends of the side panels, the tab configured to fit under a top panel of the first lid portion to close the casket body.

2. The casket of claim 1, wherein the casket body is formed from a blank of corrugated paper.

3. The casket of claim 2, wherein the casket body includes side panels foldably connected to a bottom panel.

4. The casket of claim 1, wherein the casket body, the first lid portion and the second lid portion are formed at least in part of corrugated paper.

5. The casket of claim 1, wherein the first lid portion is fitted over the box; and the second lid portion is fitted over the box.

6. The casket of claim 1, wherein the casket body, the first lid portion and the second lid portion are all formed from separate paperboard blanks.

7. The casket of claim 1, wherein the first lid portion is disposed adjacent the second lid portion.

8. The casket of claim 1, wherein the first lid portion includes side panels connected to the top panel.

9. The casket of claim 8, wherein the side panels of the first lid portion are disposed adjacent to the side panels of the second lid portion.

10. The casket of claim 8, wherein the top panel of the first lid portion is coterminous with the side panels of the first lid portion.

11. A casket comprising:

a casket body in the form of an open top box;

a first lid portion non-destructively separable from the casket body, the first lid portion including side panels connected to a top panel; and a second lid portion non-destructively separable from the casket body, the second lid portion including a top panel, side panels connected to the top panel, and a tab that extends outwardly from the top panel beyond ends of the side panels, the tab configured to fit under a top panel of the first lid portion to close the casket body; and wherein the top panel of the first lid portion is coterminous with the side panels of the first lid portion.

12. The casket of claim 11, wherein the casket body is formed from a blank of corrugated paper.

13. The casket of claim 12, wherein the casket body includes side panels foldably connected to a bottom panel.

14. The casket of claim 11, wherein the casket body, the first lid portion and the second lid portion are formed at least in part of corrugated paper.

15. The casket of claim 11, wherein the first lid portion is fitted over the box; and the second lid portion is fitted over the box.

16. The casket of claim 11, wherein the casket body, the first lid portion and the second lid portion are all formed from separate paperboard blanks.

17. The casket of claim 11, wherein the first lid portion is disposed adjacent the second lid portion.

* * * * *